US005199466A

United States Patent [19]

Corain

[11] Patent Number: 5,199,466

[45] Date of Patent: Apr. 6, 1993

[54] CONTROL DEVICE FOR THE ROCKER ARM OF A TERRY LOOM REED OPERATING MECHANISM

[75] Inventor: Luciano Corain, Vicenza, Italy

[73] Assignee: Nyuovopignone Industrie Meccaniche E Fonderia S.P.A., Florence, Italy

[21] Appl. No.: 828,235

[22] Filed: Jan. 30, 1992

[30] Foreign Application Priority Data

Feb. 13, 1991 [IT] Italy ..... MI91A000373

[51] Int. Cl.[5] ..... D03D 39/22

[52] U.S. Cl. ..... 139/27

[58] Field of Search ..... 139/27, 26

[56] References Cited

U.S. PATENT DOCUMENTS 4,099,546 7/1978 Santucci ..... 139/27

4,406,308 9/1983 Corain ..... 139/27

FOREIGN PATENT DOCUMENTS 0274119 7/1988 European Pat. Off. .

0459922 12/1991 European Pat. Off. .

2656081 12/1976 Fed. Rep. of Germany .

2486550 1/1982 France ..... 139/27

2063933 6/1981 United Kingdom .

*Primary Examiner*—Andrew M. Falik

*Attorney, Agent, or Firm*—Morgan & Finnegan

[57] ABSTRACT

A device for selecting the shift of a rocker arm of a reed operating mechanism in a terry loom includes two push rods that are hinged to the rocker arm and to two terry height adjustment levers. Each lever has a shoulder tooth cooperating with a corresponding coupling pin slidable within a guide in the control lever, urged into an active position against the action of a spring by a corresponding selection lever carrying an armature for a corresponding fixed electromagnet. The selection lever cooperates with a ledge on the control lever by way of a spring tending to withdraw the armature from the electromagnet.

1 Claim, 2 Drawing Sheets

CONTROL DEVICE FOR THE ROCKER ARM OF A TERRY LOOM REED OPERATING MECHANISM

FIELD OF THE INVENTION

This invention relates to a device for selecting the shift of the rocker arm of the reed operating mechanism of a terry loom. An electromagnet is not used for moving the pins which couple the control lever to one of the two push rods of said rocker arm. This allows the device to be sealed and hence lubricated in an oil bath. Only one operating cam for operating the lever systems and for said pin movement is used. This results in the achievement of higher operating speeds as required by modern terry looms, a longer life of the device and considerable energy saving, with consequent cost reduction.

BACKGROUND OF THE INVENTION

It is already known from U.S. Pat. No. 4,406,308 of Sep. 27, 1983, to vary the beating position of the reed of a terry loom from a "closed" or normal position to an "open" or retracted position for terry formation. The occurs by moving the rocker arm of the reed operating mechanism from its standard position against the action of a return spring, by means of a push rod which is hinged to the shank of the rocker arm. The rocker arm is driven by a control lever which is coupled to the push rod and, by means of a spring, is elastically maintained in contact with the contour of an operating cam driven by the loom drive shaft. To achieve two different terry heights without stopping the loom, two push rods are generally hinged to different points of the rocker arm shank. The selection of which push rod is to shift the rocker arm is determined by two electromagnets rigid with said control lever. The electromagnets are each arranged to magnetically move a pin coupled to the corresponding push rod.

This known device for selecting the rocker arm shift has a series of drawbacks due substantially to the vibration and wear to which the electromagnets used for moving the coupling pins are subjected. Also, the time required by said electromagnets for moving the coupling pins limits their efficiency in modern high-speed terry looms. The electromagnets also utilize considerable energy in moving the pins. A large magnetic field is required to do this with a consequent large power consumption, even if said pins are made with small dimensions to limit their inertia. Finally, the presence of these electromagnets within the region of operation of the coupling pins makes it impossible to seal this region and hence lubricate the pins in an oil bath, as would be required to increase the reliability of the mechanism and to reduce the wear of said pins to a minimum.

OBJECTS AND SUMMARY OF THE INVENTION

The object of the present invention is to obviate the aforesaid drawbacks by providing a device for selecting the shift of the rocker arm of the reed operating mechanism of a terry loom, which allows high operating speed, results in very low wear and hence a long life and a considerable energy saving, and in addition allows effective lubrication in an oil bath.

This is substantially attained by moving the slidable coupling pins from an active position to a passive position or vice versa not by electromagnets but by selection levers, one end of which cooperates via a spring with a ledge on the control lever, and the other end of which carries an armature arranged to cooperate with a respective electromagnet the only purpose of which is to retain it. The approach of the armature to the magnet is determined by the cooperation between the ledge on the control lever and the end of the selection lever. In this manner, very low feed power is required by the electromagnets with consequent considerable energy saving and there is absolutely no limitation on operating speed.

The slidable coupling pins are housed in suitable grooves in the control lever and opposed by a spring tending to urge them into a passive or retracted position within the groove. In the active or inserted position within the groove, the pins cooperate with a shoulder tooth present at one end of terry height adjustment levers which are idly pivoted on the same axis of rotation as the control lever. The adjustment levers are connected at their other end in different positions to the ends of the push rods for the rocker arm, to which the push rods are hinged at their other ends. It is apparent that in this manner the vibrations can no longer act on the electromagnets, which are now supported by a fixed element, and that the device can be easily closed hermetically and hence lubricated by an oil bath.

DESCRIPTION OF THE INVENTION

The device for selecting the shift of the rocker arm of the reed operating mechanism in a terry loom, includes two push rods for shifting a rocker arm from a standard position defined by a return spring to an operating position in which a reed is brought into a retracted or open position to form the terry. The push rods are respectively driven by a control lever which by means of a spring is elastically maintained in contact with the contour of an operating cam driven by the loom drive shaft, and is made to cooperate with one or other of said push rods. In the present invention the two push rods, hinged to the rocker arm, are also hinged at their other end to mutually different points on an arm of two terry height adjustment levers respectively, which are idly pivoted on the same axis of rotation as the control lever. Each has on their other arm a shoulder tooth arranged to cooperate with a corresponding coupling pin slidable within a guide provided in the control lever, in which the pin is retained by a spring in the passive or retracted position. The pin also cooperates with one end of a selection lever the other end of which carries the armature of an electromagnet fixedly mounted in the casing of the device, the selection lever also cooperating with a ledge on the control lever by the action of a spring which tends to withdraw the armature from the electromagnet.

The invention is further described hereinafter with reference to the accompanying drawings which illustrate a preferred embodiment thereof by way of non-limiting example in that technical or constructional modifications can be made thereto but without leaving the scope of the invention.

DETAILED DESCRIPTION OF THE INVENTION

Figure 1:
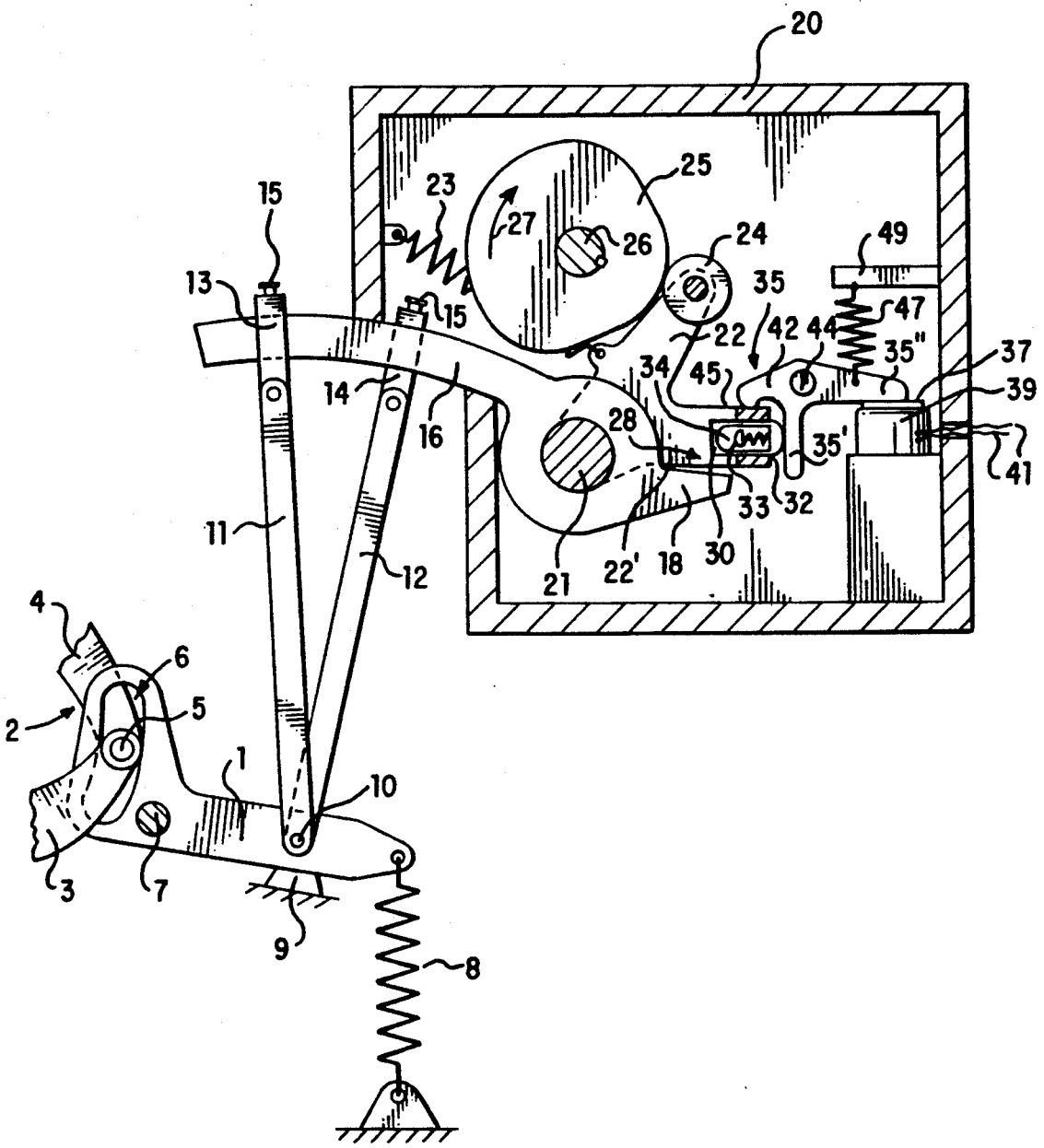
FIG. 1 is a front sectional view of a device for selecting the shift of the rocker arm of the reed operating mechanism of a terry loom, in accordance with the invention.
Figure 2:
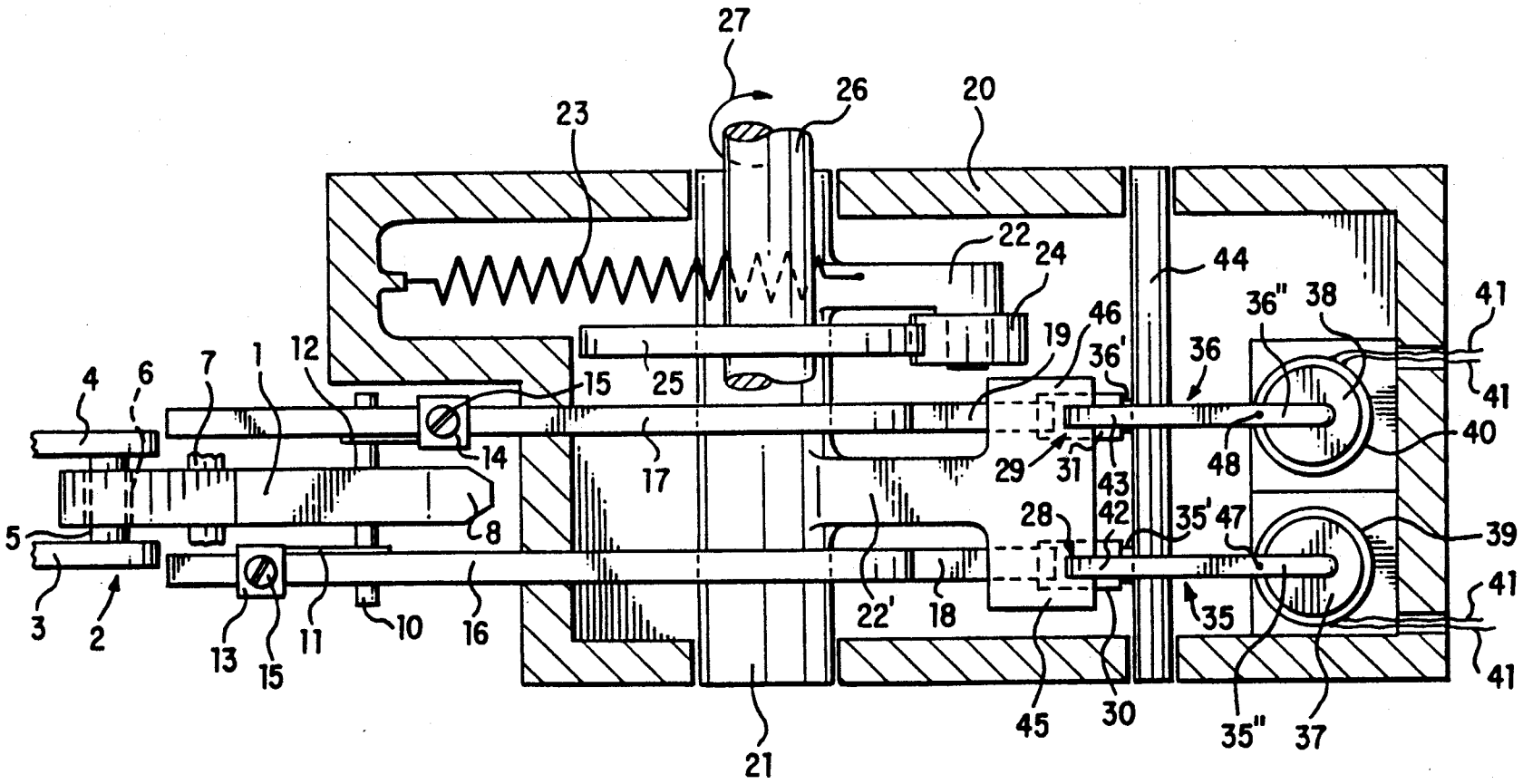
FIG. 2 is an enlarged top sectional view of the device of FIG. 1.

In the figures the reference numeral 1 indicates the rocker arm of the reed operating mechanism 2 of a terry loom which, being completely known, is represented simply by portions of the two mutually pivoted arms 3 and 4 respectively, the common joint 5 of which is inserted into and guided within the circular-arc slot 6 of the rocker arm 1.

One end of two push rods 11 and 12 is hinged by the through pin 10 to the rocker arm 1, which is pivoted at 7 and is held by a return spring 8 against a shoulder 9 to assume the standard position corresponding to the reed in the normal beating position. The other end is hinged to a bock 13 and 14 respectively. The blocks 13 and 14 are fixed respectively, by screws 15, to mutually different points on an arm of two terry height adjustment levers 16 and 17 respectively, on the other arm of which there is provided a shoulder tooth 18 and 19 respectively. These latter levers 16 and 17 are inserted into the sealed casing 20 of the device and are mounted idly on the shaft 21 which rotates the control lever 22 which is maintained by a spring 23 with its roller 24 elastically in contact with the contour of the operating cam 25 fixed on the shaft 26 driven in the direction of the arrow 27 by the loom drive shaft, and comprises on its arm 22' two guides, 28 and 29 respectively, for two slidable coupling pins 30 and 31 arranged to cooperate respectively with said shoulder teeth 18 and 19 of levers 16 and 17. Pins 30 and 31 tend to assume a passive or retracted position, i.e., beyond the influence of the respective teeth 18 and 19, each by the action of a spring 32 acting between an appendix 33 projecting from said control lever 22 and inserted in a slot 34 in the pins, and the rear wall of the slot. The coupling pins 30 and 31 also cooperate with the end, 35' and 36' respectively, of two selection levers 35 and 36 pivoted on the same axis 44, their other end, 35" and 36" respectively, carrying the armature, 37 and 38 respectively, of two electromagnets 39 and 40 fixed in the casing 20 of the device and energized by an electronic control unit (not shown on the figures), to which they are connected by the conductors 41. Finally, the selection levers 35 and 36 comprise appendices, 42 and 43 respectively, which are maintained in contact with corresponding ledges 45 and 46 on the control lever 22 by the action of springs, 47 and 48 respectively, which act between the ends 35" and 36" of the selection levers 35 and 36 and a fixed support 49 in the sense of withdrawing the armatures 37 and 38 from the respective electromagnets 39 and 40.

The method of operation of such a device is apparent.

While the contour of the operating cam 25 presents a protuberance in front of the roller 24 of the control lever 22, this latter is obliged to rotate clockwise about the shaft 21, with corresponding rotation of the coupling pins 30 and 31. At this point two cases can arise. The electromagnet 39 is energized and retains against itself the armature 37 of the selection lever 35, which therefore remains in the position shown in FIG. 1 and therefore continues to retain the coupling pin 30 in the active or inserted position against the action of the spring 32. In this arrangement the pin cooperates with the shoulder tooth 18 of the terry height adjustment lever 16 to oblige this latter lever to rotate clockwise about the shaft 21 and cause the rocker arm 1 to rotate anticlockwise about the axis 7 against the action of its return spring 8 and hence position the loom reed in its open or retracted position to form the terry. Alternatively, the electromagnet 39 is not energized so that when the control lever 22 rotates to lower its ledge 45, the selection lever 35 is now obliged by its spring 47 to rotate anticlockwise about the axis 44, enabling the spring 32 of the coupling pin 30 to move the pin into its passive or retracted position so that, as there is no longer cooperation with the tooth 18, the lever 16 does not rotate. The result is that the rocker arm 1, by the effect of the return spring 8, remains in the position of FIG. 1 corresponding to the reed in its closed or normal position. It is apparent that the continuous cooperation between the ledge 45 of the control lever 22 and the appendix 42 of the selection lever 35 always moves this latter lever into the position shown in FIG. 1 each time the control lever 22 is compelled to rotate anticlockwise.

We claim:

1. A device for selecting the shift of a rocker arm of a reed operating mechanism in a terry loom, comprising a rocker arm, two push rods, each having respective ends, for shifting said rocker arm from a standard position defined by a return spring to an operating position in which a reed is brought into a retracted or open position to form the terry, said push rods being driven respectively by a control lever rotatable about an axis which by means of a spring is elastically maintained in contact with a contour of an operating cam driven by a loom drive shaft, and is made to cooperate with one of said push rods, said two push rods are respectively hinged to said rocker arm at one end and at another end to mutually different points on respective arms of two terry height adjustment levers, which are idly pivoted on said axis of rotation of said control lever and each terry adjustment lever has a shoulder tooth arranged for cooperation with a corresponding coupling pin slidable within a guide provided in said control lever, in which each said pin is retained by a spring in a passive or retracted position, each said pin also cooperates with one end of a selection lever, another end of said selection lever carries an armature of an electromagnet fixedly mounted in a casing, said selection lever also cooperates with a ledge on said control lever by the action of a spring which withdraws said armature from said electromagnet.

* * * * *